United States Patent [19]

Jackman

[11] 4,071,723

[45] Jan. 31, 1978

[54] PLUNGER-RELEASE SHOCK RESPONSIVE CONTROL APPARATUS HAVING ADJUSTABLE SEAT FOR SENSOR MASS

[75] Inventor: Peter Ronald Jackman, Basingstoke, England

[73] Assignee: Inertia Switch Limited, Hartley Wintney, England

[21] Appl. No.: 688,337

[22] Filed: May 20, 1976

[30] Foreign Application Priority Data

May 13, 1975 United Kingdom ..... 20161/75

[51] Int. Cl.[2] ..... H01H 35/00

[52] U.S. Cl. ..... 200/61.45 R; 200/61.52

[58] Field of Search ..... 200/61.45 R–61.53, 200/DIG. 29; 73/493, 488, 517 R, 517 A

[56] References Cited

U.S. PATENT DOCUMENTS

| | | | |
|---|---|---|---|
| 1,656,704 | 1/1928 | Golombowski | 200/61.52 |
| 3,769,472 | 10/1973 | Bell et al. | 200/61.52 X |
| 3,812,308 | 5/1974 | Bell et al. | 200/61.52 X |
| 3,816,680 | 6/1974 | Suzuki et al. | 200/61.52 X |
| 3,916,127 | 10/1975 | Roesch et al. | 200/61.45 R X |
| 3,927,286 | 12/1975 | Fohl | 200/61.52 X |
| 4,001,185 | 1/1977 | Mitsui et al. | 200/DIG. 29 |

*Primary Examiner*—James R. Scott
*Attorney, Agent, or Firm*—Foster York

[57] ABSTRACT

A shock-responsive control apparatus has a seismic ball mounted in a seat formed in a cup-shaped member and surrounding the plunger of a switch.

As the ball crosses a circular region, at which the inclination of the seat to the central axis of the apparatus increases, its path becomes more closely aligned with the resultant force acting on the apparatus and the ball is accelerated more rapidly out of obstructing engagement with the plunger.

Sensitivity is controlled by moving the seat relative to the plunger by means of a screw-threaded mounted cover for the cup-shaped member.

3 Claims, 3 Drawing Figures

PLUNGER-RELEASE SHOCK RESPONSIVE CONTROL APPARATUS HAVING ADJUSTABLE SEAT FOR SENSOR MASS

BACKGROUND OF THE INVENTION

The invention relates to plunger-release, shock-responsive control apparatus in which a seismic mass mounted in a concave seat is movable from a rest position, in response to a variation of predetermined magnitude in the forces acting on the seismic mass, to effect a switching operation by moving away from a rest position where it normally holds a plunger depressed against the influence of a force urging the plunger out of its depressed position.

In one most effective form of shock-responsive switching device constructed in accordance with this principle, a seismic ball is mounted in a frusto-conical seat. When the device is subjected to a lateral acceleration, as a result of a lateral shock loading on the device, the ball is accelerated relative to the seat in a direction opposite to the shock loading on the device. The ball therefore behaves as if acted upon by a lateral force which is oppositely directed and proportional to the shock loading on the device. If the resultant of this notional lateral force, the upward force exerted by the plunger on the ball, and the downward gravitational force acting on the ball passes out the support base defined by the zone of contact between the ball and frusto-conical seat, the ball accelerates up the side of the seat at a rate proportional to the component of the resultant force acting parallel to the side of the seat.

As a result of this acceleration of the ball, away from its rest position, the device is enabled to change its mode by allowing the plunger to rise out of its depressed position.

For a shock-responsive switching device such as this, in which the sides of the frusto-conical seat are inclined at an angle $\alpha$ to the central axis of the seat and the seismic ball is subjected to a resultant force $F_r$ inclined at an angle $\beta$ to the central axis of the seat, the component $F_\alpha$ of the resultant force $F_r$ tending to drive the ball along the side of the seat may be expressed as follows:

$$F_\alpha = -F_r \cos(\alpha + \beta)$$

Thus, if $(\alpha + \beta)$ exceeds 90° the resultant force $F_r$ will urge the seismic ball out of its seat with an acceleration proportional to the component force $F_\alpha$, so that a shock-responsive switching device in which the sides of the frusto-conical seat have a particular inclination, angle $\alpha$, is responsive to the inclination, angle $\beta$, of the resultant force $F_r$ acting on the siesmic ball.

In practice, this principle is utilised to operate shock-responsive switching devices in response to the variation in inclination of a resultant force acting on a seismic ball mounted in a frusto-conical seat when this variation in inclination results either from the imposition of a lateral shock loading on the gravitational force acting on the ball, as in shock loading responsive switches, or from the tilting of the device so as to alter the inclination of the line of action of the gravitational force acting on the seismic ball, as in roll-over switches. These horizontal acceleration and inclination parameters are also relevent to the design of shock-responsive switching device for controlling the fastening of seat belts.

In order to ensure that a device constructed so as to operate according to this principle does not operate in response to stimuli of less than a particular threshold value, for example: for variations of less than 15° in the inclination of the resultant force acting on the seismic ball, so as to reduce the sensitivity of the device, it is necessary to reduce the angle $\alpha$ so as to increase the steepness of the sides of the frusto-conical seat. However, this form of construction suffers the disadvantage of the slow response normally obtained as a result of the finite time necessary for the seismic ball to accelerate to a velocity at which an unrestrained plunger is able to rise out of its depressed position, so as to ensure rapid and positive operation of an electric switch actuated by the plunger to reduce arcing and thus prolong the life of the electric switch.

One way of reducing this disadvantage is to use a seismic ball of ferromagnetic material and to impose a magnetic restraint on the ball by means of a magnet disposed below the frusto-conical seat. This restraint of the seismic ball, by magnetic attraction, is such that it prevents premature departure of the seismic ball from its rest position until the device is subjected to a stimulus in excess of the desired threshold value. This restraint also diminishes rapidly as the ball moves away from its rest position, thereby increasing the resultant force component urging the ball up along the side wall of its seat and so shortening the time taken for the ball to reach a sufficiently high velocityto allow a depressed plunger to rise without obstruction. In both cases, the seismic ball experiences an unstable condition and there is a commitment to complete the mode-changing operation of the device.

However, in spite of considerable shortening of the resonse time by means of the magnetic restraint imposed on the seismic ball, so that response times, in typical cases, are divided by factors of between 10 and 20, even greater reductions in response time are required in many applications such in seismonastic control apparatus for operating safety devices in response to motor vehicle collisions.

SUMMARY OF THE INVENTION

It is therefore an object of the present invention to provide a less complicated form of shock-responsive switching device which will not operate unless actuated by a stimulus of predetermined magnitude, but when so actuated will operate more rapidly than a conventional shock-responsive switching device in which a seismic ball is mounted for movement along a frusto-conical surface of a seat.

According to the invention, there is provided a plunger-release, shock responsive control apparatus having a switching device comprising a cup member which is movable in an annular-section projection and defines a coaxial concave seat, a spherical seismic roller accommodated in the seat, a plunger which is disposed below the roller and movable along a central axis extending through the centre of the seat and the roller, a cover for the cup member connected to the annular projection by screw-threaded means for moving the cup member relative to the plunger, and means effective to lift the plunger on movement of the roller away from the centre of the seat, the seat comprising a concave surface including a region which is engaged by the seismic roller during operation of the switch and at which there is an increase in the inclination of the surface of the seat to the central axis so that, in any axial plane, the increased inclination is greater than the inclination of the tangent to the roller at the point of contact between the roller and the seat when the roller is in its rest position.

When a shock-responsive switching device such as this is subject to a variation in the forces acting on the device so that the roller is subject to a force component acting parallel to the surface engaged by the roller, the roller will accelerate out of the seat. However, at the instant when the roller comes into engagement with the region of the surface of the seat at which there is an increase in the inclination of the surface to the central axis, the roller will change its direction of movement so aas to become more closely aligned with forces acting on the switch and there is a consequential increase in the component force urging the roller along the surface of the seat. This increased loading on the roller gives rise to a greater acceleration of the roller and so displacement of the roller is effected more rapidly than would otherwise be the case.

In a preferred embodiment of the invention, the roller is in the form of a spherical ball which rests on the circular edge between two intersecting surfaces of revolution around the central axis. It is then possible, with this form of construction, to control sensitivity by varying the relative diameters of the ball and the circular edge. Moreover, when the effective force acting on the ball has a component acting perpendicular to a radius extending from the centre of the ball to a point on the seat, the ball will tilt about this point and the centre of the ball will follow an arcuate path described about the point. As a result, the direction of movement of the ball becomes more closely aligned with the effective force acting on the ball and so the ball is accelerated at an even greater rate around its arcuate path, to release the plunger more rapidly.

DESCRIPTION OF THE DRAWING

An embodiment of the invention is hereinafter described, by way of example, with reference to the accompanying drawing, in which.

DESCRIPTION OF THE ILLUSTRATIVE EMBODIMENT

Figure 2:
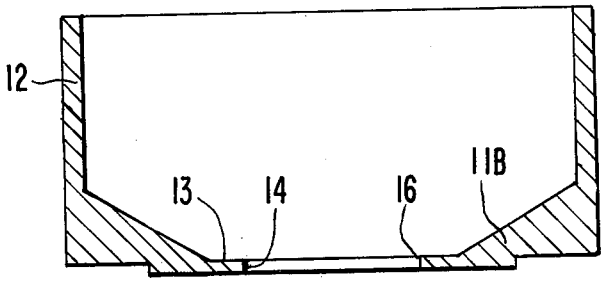
FIG. 2 is a sectional elevation of a cup member forming part of the apparatus shown in FIG. 1, to a larger scale.
Figure 1:
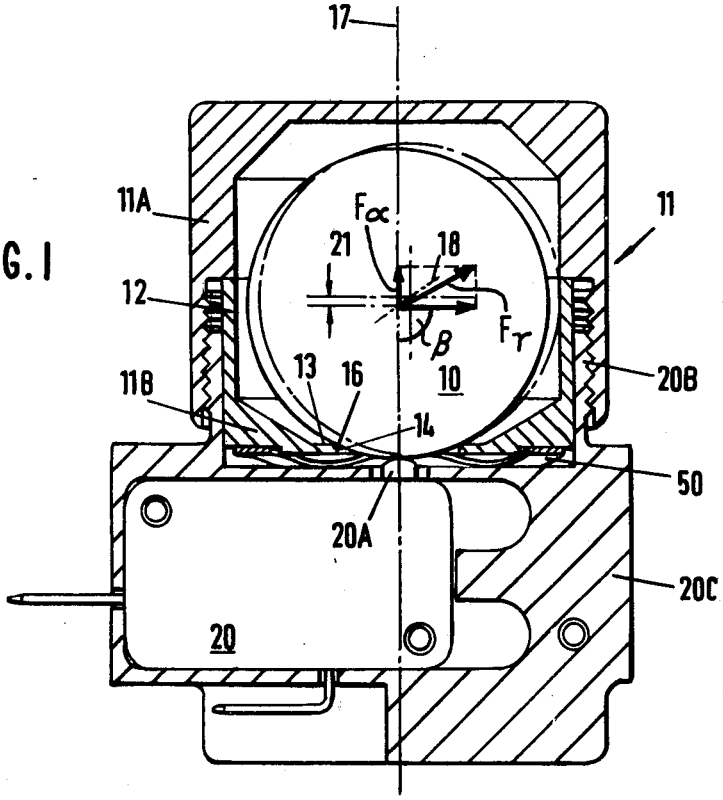
FIG. 1 is a sectional elevation of a shock-responsive control apparatus for use in a locking device for seat belts, in which a roller is required to release a plunger to effect operation of a switch.

As shown in FIG. 1 of the drawing, a steel ball 10 is mounted in a ball chamber 11 comprising a cover member 11A and a cup member 11B as shown in FIG. 2, the cup member 11B is formed with an upper cylindrical surface 12, a planar seat surface 13, which is annular in shape, and a lower cylindrical surface 14, which surrounds the upper end of a plunger 20A of a microswitch 20, to provide a seat for the ball 10. The inclination of the surface 14 to the central axis 17 of the seat, represented by angle $\alpha$, is zero and the circular edge 16 between the planar seat surface 13 and the lower cylindrical seat surface 14 is of smaller diameter than the ball 10 so as to support the ball 10 with its centre of gravity disposed on the central axis 17. In this position, the ball 10 rests on the plunger 20A so as to hold it in a depressed position.

On actuation of the apparatus, by the application of a shock load such that the inclination $\beta$ of the resultant force $F_r$ exceeds 90°, there is a component force $F_\alpha$ equal to $-F_r \cos(\alpha + \beta) = F_r \cos(\beta - 90°)$ and the centre of gravity of the ball 10 moves around an arcuate path 18 described about a point on the edge 16 and so rises through a vertical distance 21. This movement of the ball 10 is sufficient to allow the plunger 20A of the microswitch 20 to rise from its depressed position so as to effect a mode-changing operation of the microswitch 20.

Thus, when experiencing tilt or horizontal acceleration above a predetermined threshold, the ball 10 "falls over" the sharp edge 16 so as to operate the switch 20 mounted beneath it. As the operate point of the unit is partly determined by the release force of the microswitch 20 and release forces are not normally closely controlled by manufactuers, the apparatus switch may be designed to operate with no release force assisting the ball 10 out of the seat. This would not be possible with a ramp seat of uniform inclination, because the over-balance point would not exist. This is another advantage of the design.

Figure 3:
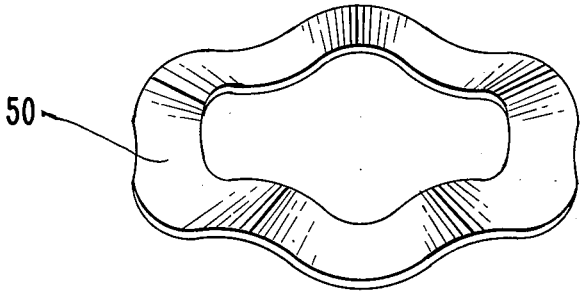
FIG. 3 is a perspective view of a wavy spring washer forming anothr part of the apparatus shown in FIG. 1, to a larger scale.

In the switch shown in the drawing, the cover member 11A is screw-threaded to an annular-section projection 20B upstanding from the housing 20C of the microswitch 20. Thus, as the cover member 11A is screwed downwards, it presses again the outer rim of the cup member 11B which is supported by the compressive resistance of a wavy spring washer 50 as shown in FIG. 3, which presses the cup member 11B resilient upwards. The seat portion 11B is therefore lowered and the ball 10 is rested on the upper end of the plunger 20A.

I claim:

1. A plunger-release, shock-responsive control apparatus comprising:

a first housing having an upper wall, which is formed with a plunger aperture, and an external annular-section projection surrounding said aperture and extending vertically along a central axis passing through the plunger aperture;

a second housing having a cup member, which is axially movable in the annular-section projection and defines a coaxial concave seat of circular cross-section, and having a cover which is directed away from said upper wall;

screw-threaded means connecting the cover to the annular projection for moving the cup member relative to the first housing so as to effect vertical adjustment of the concave seat;

a two-mode control device operable, in different modes, to perform two different control functions and having a plunger which is axially aligned with said aperture and is operable, on actuating movement along the central axis between a depressed position and an elevated position, to effect a change of mode of said control device; and a seismic roller, accommodated in the concave seat, above the plunger, for lateral movement, as a result of a predetermined variation of the resultant of all forces acting on the roller, from a rest position on the central axis where the weight of the roller prevents movement of the plunger from the depressed position to the elevated position, so as to allow the plunger to move to its elevated position;

the seat defining a concave surface extending from said central axis and including a region which is engaged by the seismic roller during said lateral movement from its rest position and at which region there is an increase in the inclination of the surface of the seat to said central axis so that, in the axial plane of lateral movement of the roller the increased inclination is greater than the inclination of the tangent to the roller at the point of contact between the roller and the seat when the roller is in its rest position.

2. Apparatus, according to claim 1, in which:

compressive spring means are disposed between said upper wall of the first housing and said cup member of the second housing;

said cup member has an outer rim which is directed away from said upper wall;

the cover is separable from the cup member and engages the outer rim of the cup member; and the screw-threaded means are formed on the cover member and the annular projection for pressing the cup member towards the first housing against the resistance of the compressive spring means.

3. Apparatus, according to claim 1, in which:

said seismic roller is spherical in shape;

said concave surface is a surface of revolution extending around the central axis; and said region is circular so as to be engaged by the seismic roller during movement of the roller along any radially extending axial plane.

* * * * *